US005690330A

United States Patent [19]

Ozawa

[11] Patent Number: 5,690,330

[45] Date of Patent: Nov. 25, 1997

[54] TOY BASKETBALL GAME WITH SELF-JUMPING PLAYER

[75] Inventor: Isamu Ozawa, Tokyo, Japan

[73] Assignee: The Ohio Art Company, Bryan, Ohio

[21] Appl. No.: 711,054

[22] Filed: Sep. 9, 1996

[51] Int. Cl.[6] ..... A63F 7/06

[52] U.S. Cl. ..... 273/108.56; 273/108.1; 273/108.5; 273/317.3; 446/309; 446/330; 446/376; 446/390; 446/354

[58] Field of Search ..... 273/108, 108.1, 273/108.55, 108.56, 317.1, 317.3, 440, 317; 446/309, 376, 390, 429, 311, 312, 317, 330, 352, 353, 354

[56] References Cited

U.S. PATENT DOCUMENTS

| | | | |
|---|---|---|---|
| 1,433,335 | 10/1922 | Bensch | 273/317.3 |
| 2,433,224 | 12/1947 | Koci et al. | 273/317.3 |
| 2,627,700 | 2/1953 | Weiss | 446/312 |
| 2,799,501 | 7/1957 | Barbolla | 273/317.3 |
| 4,480,834 | 11/1984 | Minami | 273/317.3 |
| 5,087,219 | 2/1992 | Price | 446/354 X |

*Primary Examiner*—Raleigh W. Chiu
*Attorney, Agent, or Firm*—Hugh Adam Kirk

[57] ABSTRACT

A toy basketball game having a court floor, a stand attached to the floor for a backboard ring and net, an articulated player and a movable base for the player. The player contains a compressible spring in one leg which is held compressed by a lever on the player's leg, which lever releases the spring to cause the player to jump and to raise its arm having in its hand a releasable ball, which ball releases when the player's arm contacts the ring of the basketball basket. The base has a rotatable wedge-shaped plate for changing the angle of jump of the player so as to cause the player to be projected toward the ring from any location of its stand on the court. If desired, the ring and the arm of the player may be provided with adhering roughened surfaces so that the player can hang on the ring.

15 Claims, 6 Drawing Sheets

TOY BASKETBALL GAME WITH SELF-JUMPING PLAYER

BACKGROUND OF THE INVENTION

Although toy basketball games are known with articulated players that rotate and bend and contain internal springs for moving their limbs, and separate launching devices for balls, and even VELCRO, a hook-and-loop fastener on projectiles to hold them on their targets, applicants know of no toy articulated figures which jump with a ball by an internal powered launching device built in the body of the figure, or that can hang on a ring of a simulated basketball basket.

SUMMARY OF THE INVENTION

Generally speaking, this invention comprises a toy basketball court with a stand for basket or goal attached thereto and movable and adjustable bases on the floor of said court, which bases support an articulated player holding a toy basketball.

The improvement of this game is that the player figure, including the ball, are self-propelled from an adjustable and movable base, and the skill in the game is to so adjust the base that when it releases the player, the player will jump toward the basket and deposit the ball therein. This is accomplished by a compressible spring in the one leg of the player, which spring is held compressed by a release lever mechanism on the base, so that when the spring in the leg is released the spring causes the player to jump and to raise its arm holding the ball so that the player's arm hits the ring of the basket and deposits the ball in the basket. Furthermore, if desired, a VELCRO of coating can be placed on the ring of the basket and on the wrist of the player so that the player will hang on the basket when the ball is deposited therein.

OBJECTS AND ADVANTAGES

It is an object of this invention to produce a toy basketball game of skill in which the toy player retains the ball and jumps with it toward the goal or the basket for the ball.

Another object is to produce such a toy basketball game in which the player figure can hang on the basket or ring thereof when the ball is deposited therein from the hand of the player.

Still another object is to produce a toy basketball game of skill in which the animated players jump with the ball instead of throwing the ball to the basket.

Still another object of the invention is to form and name the articulated player figures after famous basketball players.

The above mentioned and other features and objects of this invention and a manner of obtaining them will become more apparent and the invention itself will be understood better by reference to the following description of a preferred embodiment of this invention taken in conjunction with the accompanying drawings wherein.

DETAILED DESCRIPTION OF PREFERRED EMBODIMENT

Figure 1:
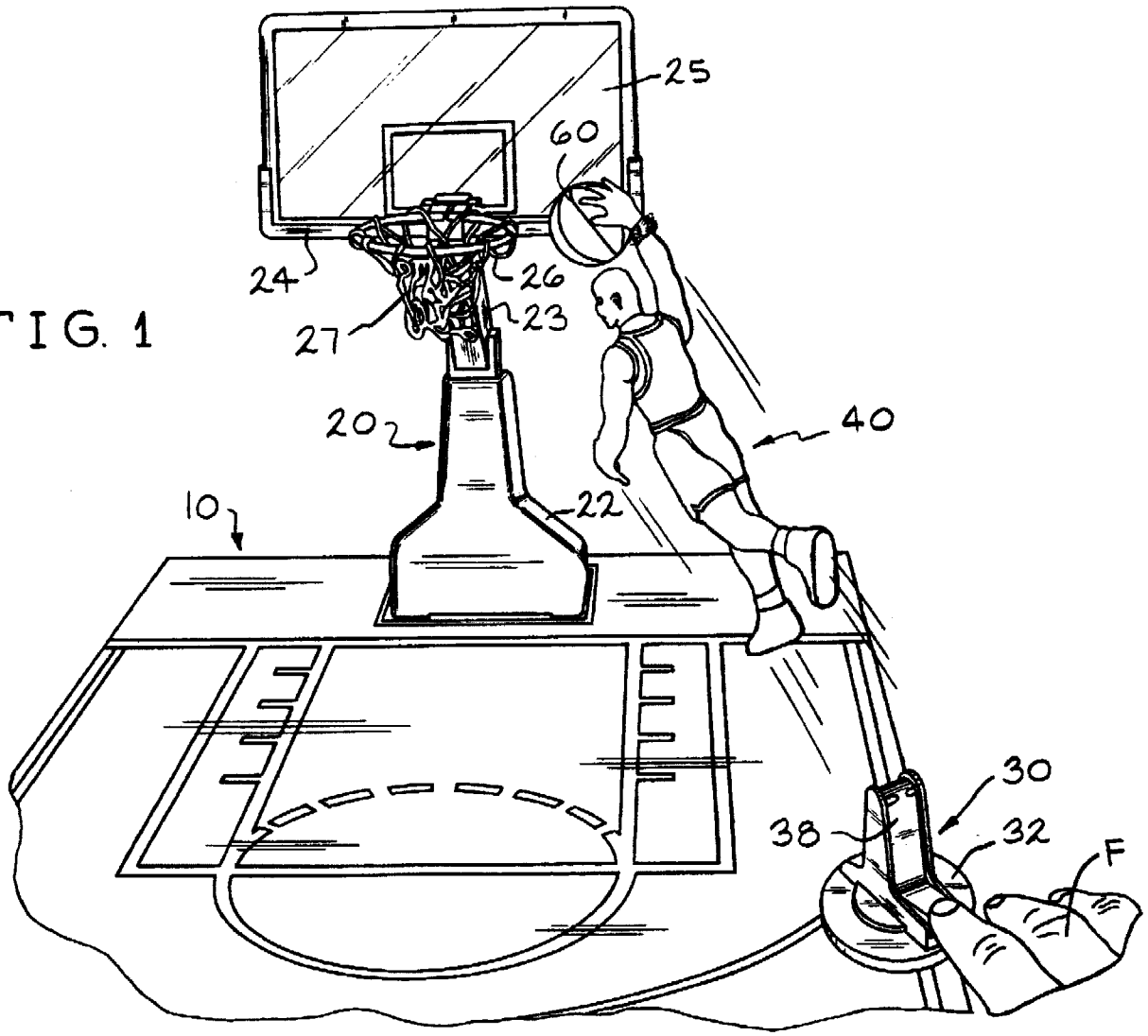
FIG. 1 is a perspective view of the toy game showing a simulated basketball court and player figure with ball in hand being projected from a movable base, which base releases the player to be self-propelled toward the basket.

Referring first to FIG. 1, the major elements of this invention are disclosed, namely: the simulated half of a basketball court floor 10, and attached thereto a stand 20 for a basketball basket, which stand is attached to the floor 10 either by vacuum suction cups or magnets or locked in place by a slide connection. Then there is the movable and adjustable support base 30 for the animated player 40 and the ball 60 held by the player.

Figure 2:
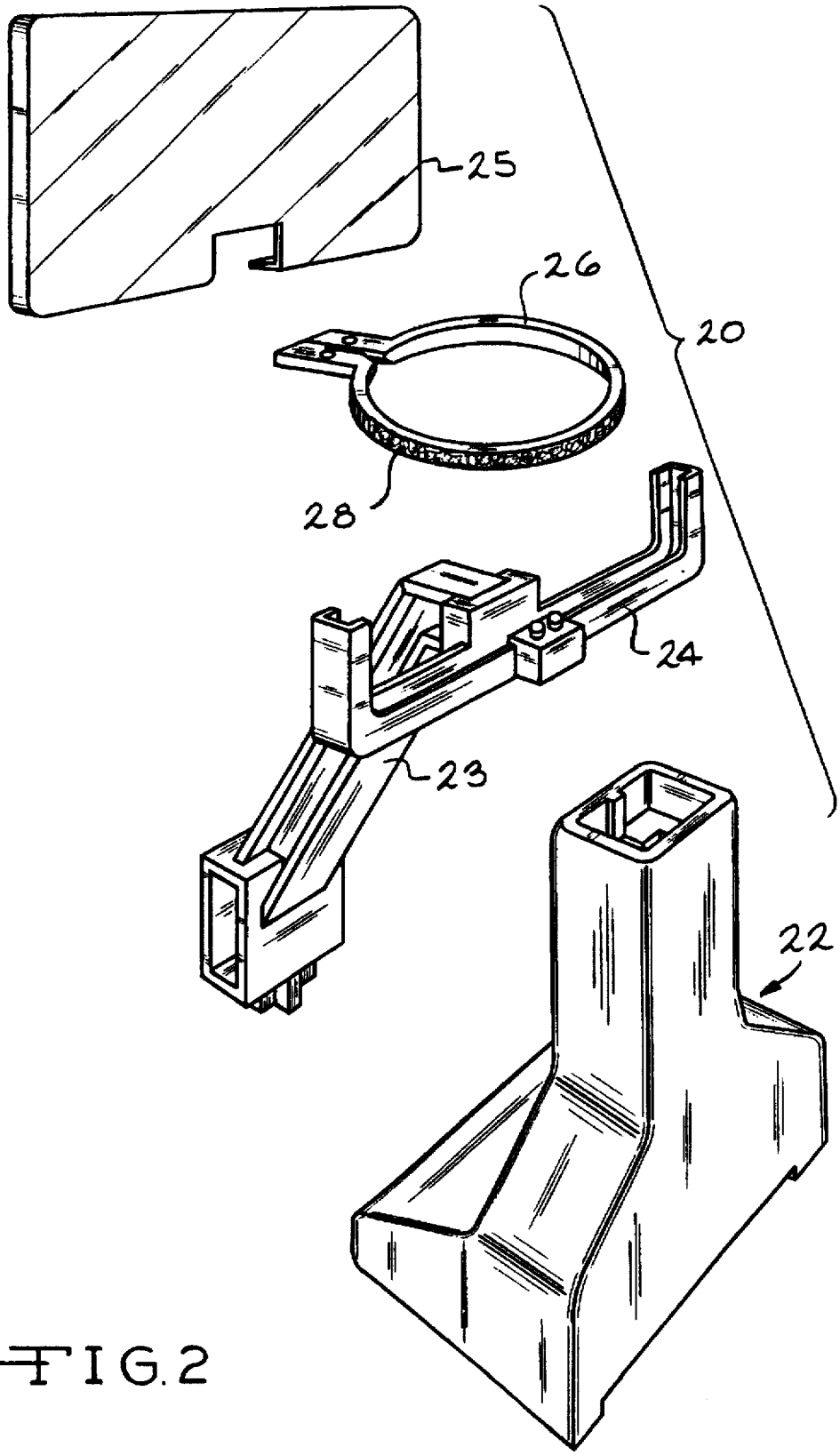
FIG. 2 is an exploded perspective view of the parts that form the stand that holds the backboard, ring and basket shown in FIG. 1.
Figures 3, 4:
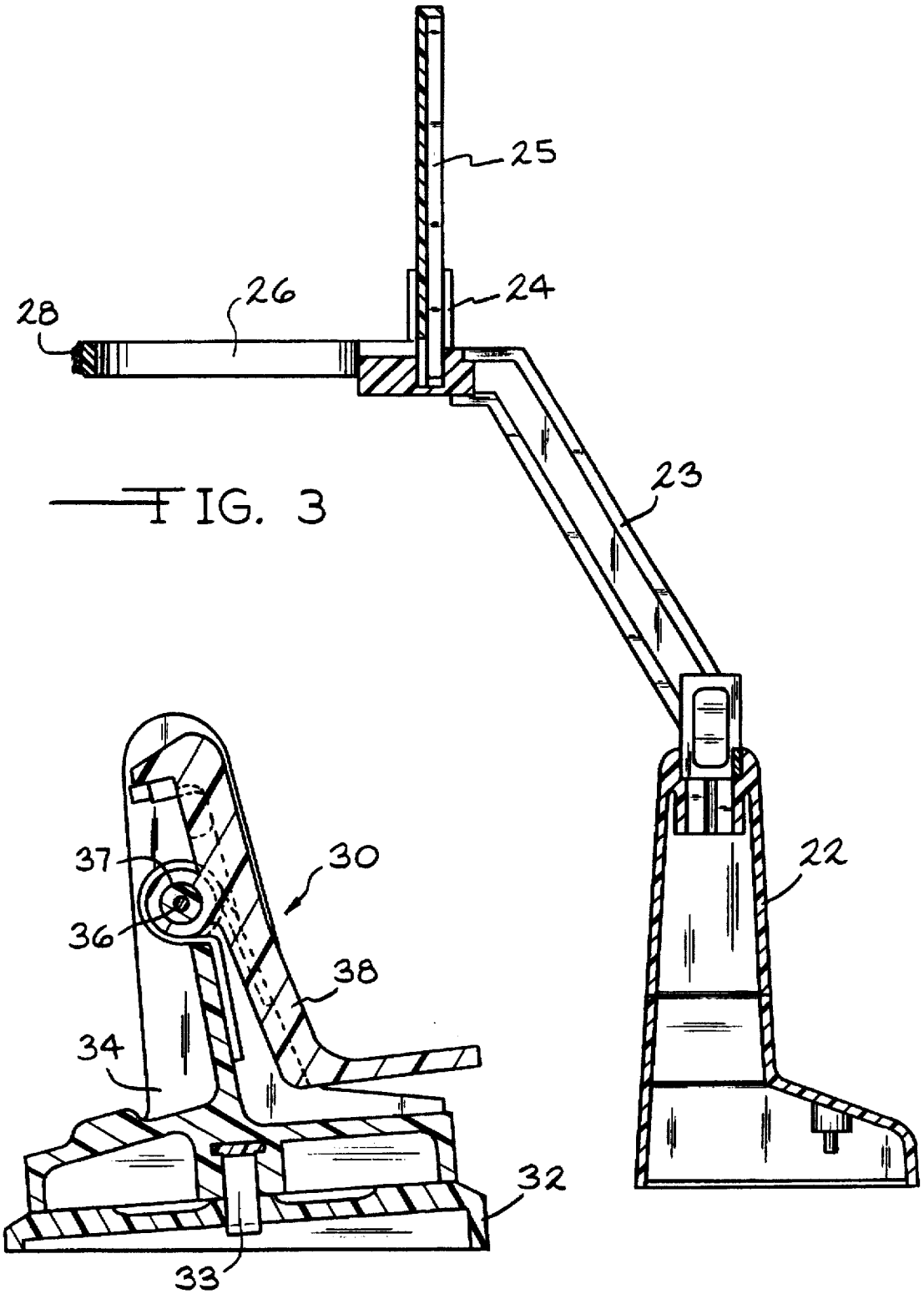
FIG. 3 is a vertical sectional view of the assembled parts of the stand for the basket and its ring shown in FIGS. 1 and 2.
FIG. 4 is a vertical sectional view of the base for mounting the player and the lever release for the player shown in FIGS. 1, 5 and 6.
Figure 5:
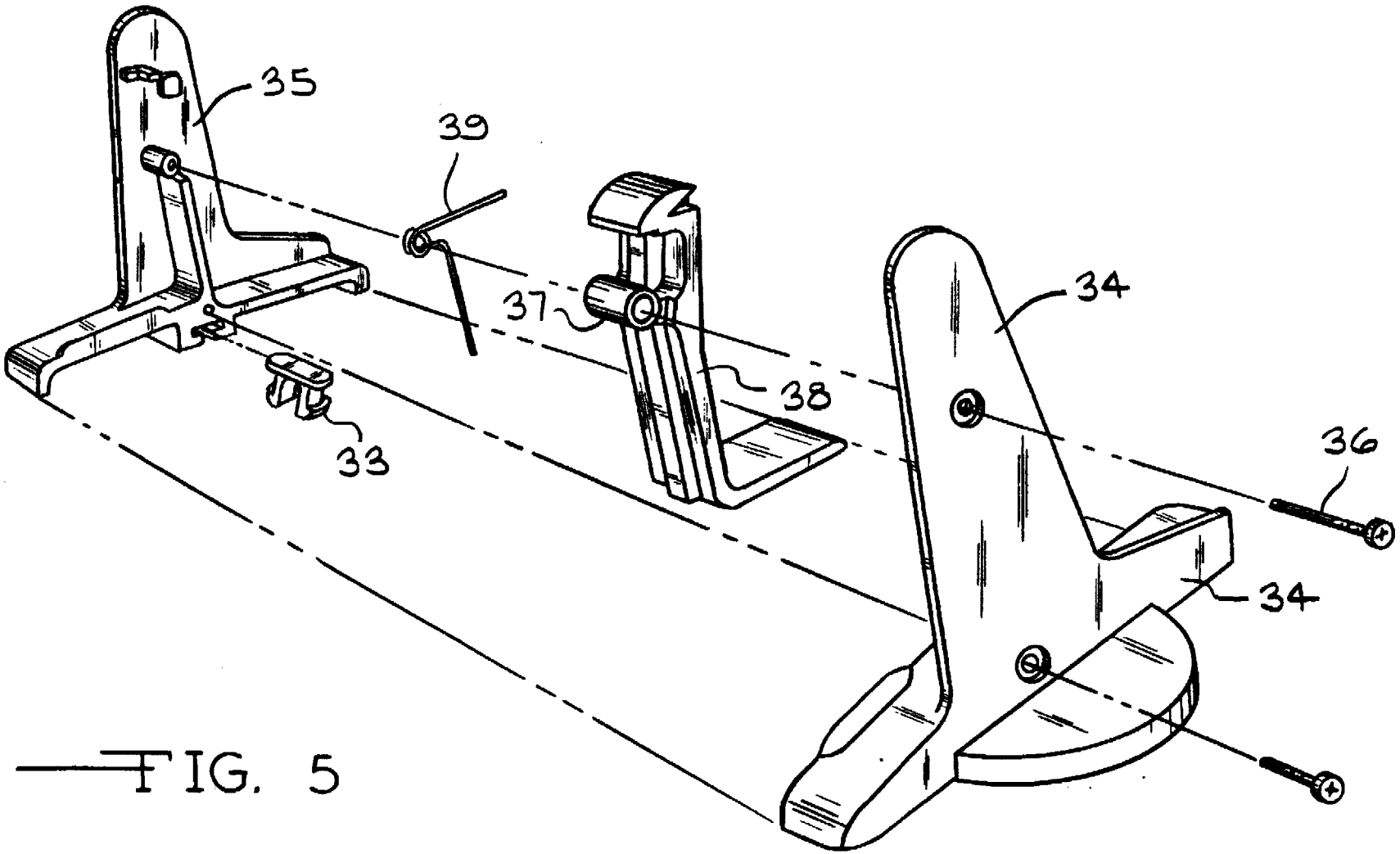
FIG. 5 is an exploded perspective view of the parts of the base for holding the player figure shown in FIGS. 1, 4 and 6.

Referring to FIGS. 1 and 2, the basket or goal stand comprises a base member 22 angularly outward extending arm 23 which contains a frame 24 that holds a backboard 25 and the ring 26 of a basketball basket from which ring is suspended a net 27. In FIG. 3 there is shown a VELCRO coating 28 on the outside of the ring 27. The parts of this stand for the ring 26 may be made of plastic and snap-fit together as shown in exploded FIG. 2.

Referring next to FIGS. 1, 4, 5 and 6, there is the movable adjustable support base 30 for the player 40 comprising a bottom wedge-shaped plate 32 in FIG. 4 having a central vertical piece 33 upon which rotates parallel upright side portions 34 and 35. Between these upright portions 34 and 35 there is a horizontal pivot pin 36 through a hub portion 37, upon which hub pivots the release lever 38 held in engagement position by a wire spring 39 (see FIG. 5). This spring 39 urges the lever 38 into the position shown in FIG. 6, namely to hold the spring 42 in the player figure compressed as will be described below.

Figure 6:
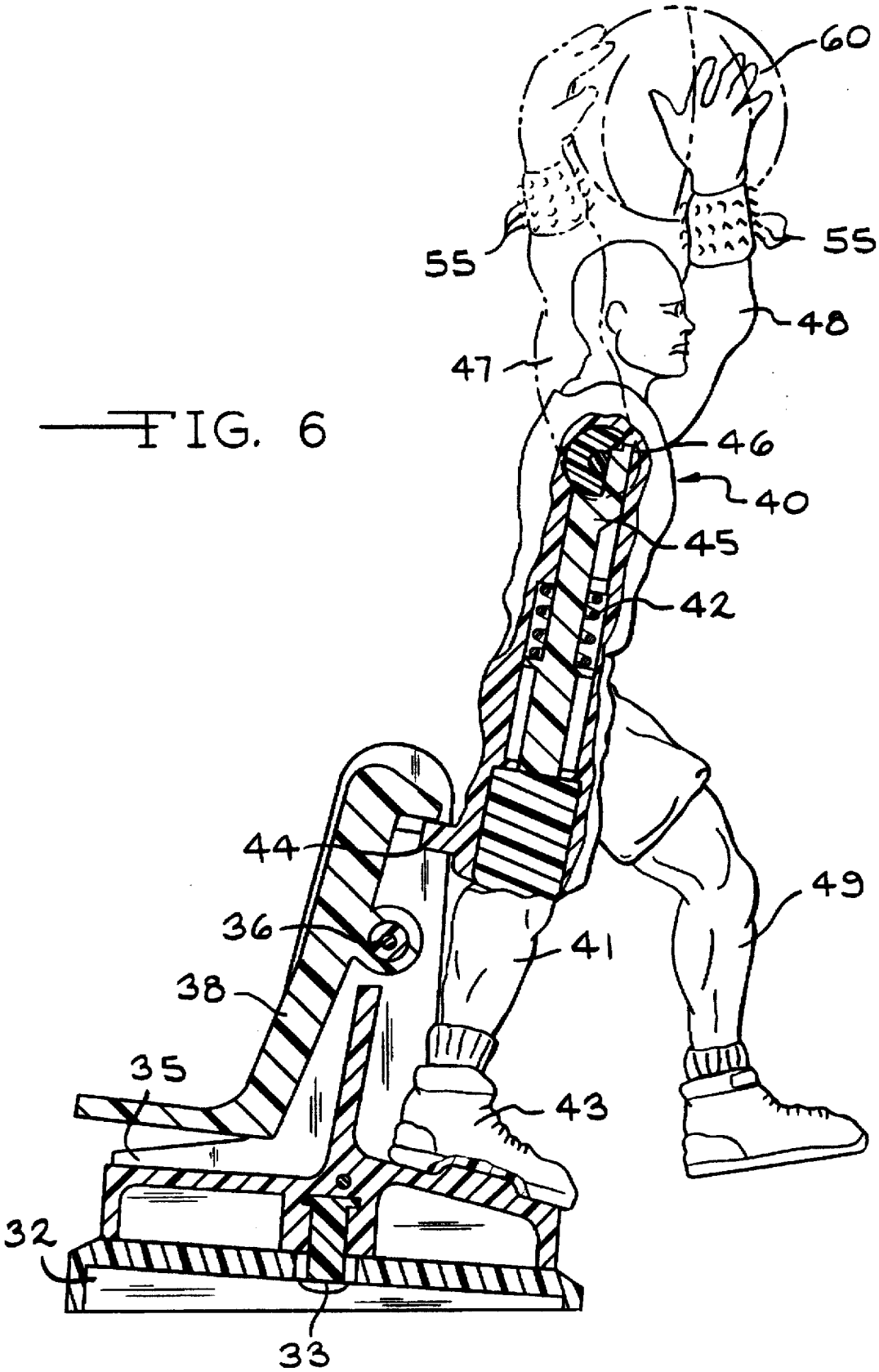
FIG. 6 is a vertical sectional view showing a player's leg and compressed internal spring being held in the lever of the base shown in FIGS. 1 and 4.
Figure 7:
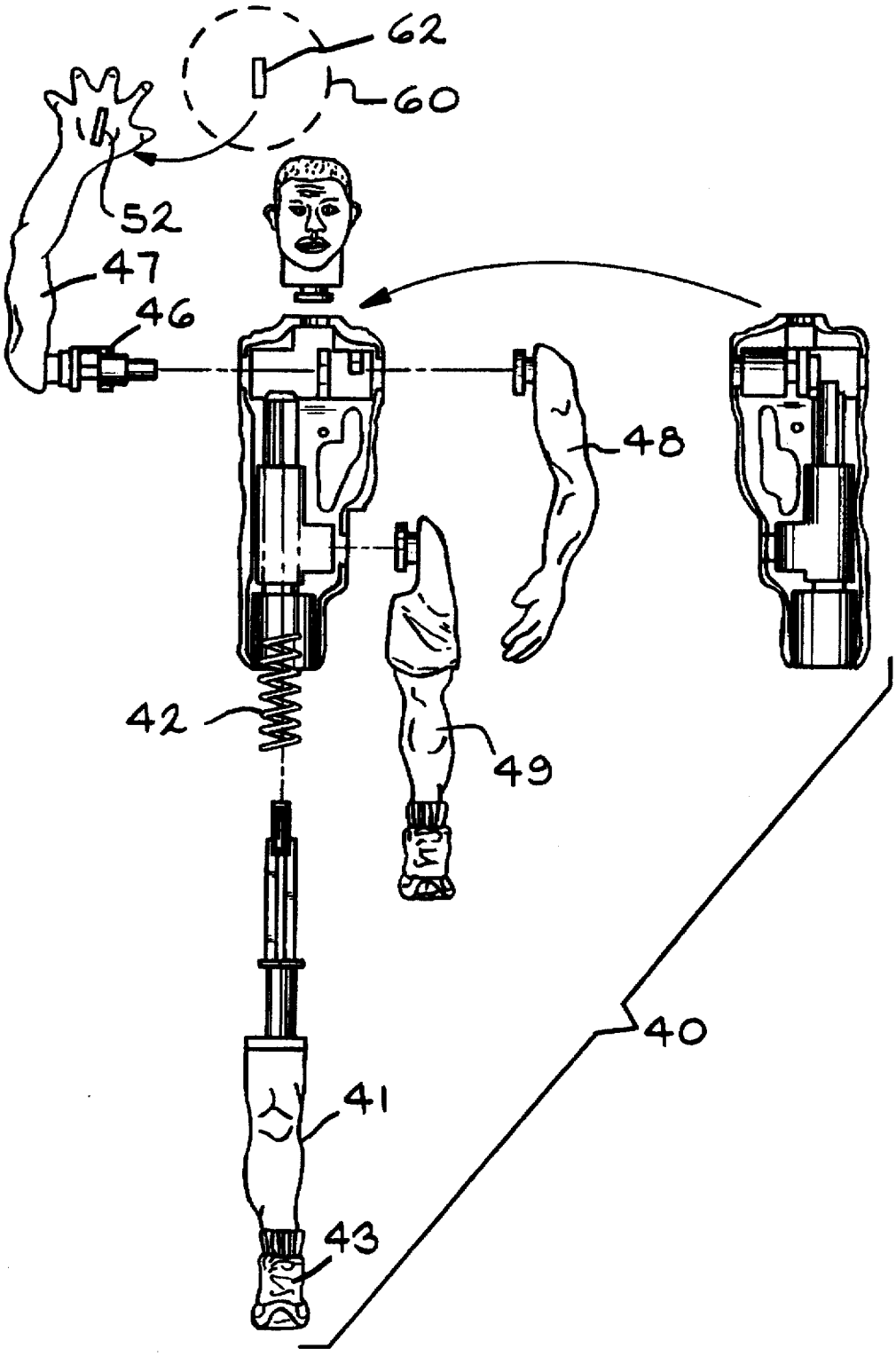
FIG. 7 is an exploded view of the parts of the player shown in FIGS. 1 and 6 showing the internal spring and mechanism in the shoulder of the player for raising its hand that holds the ball.

Referring to FIGS. 1, 6 and 7 there is shown the animated player figure 40 which comprises a telescopic leg 41 inside of which is a coil spring 42 which is held compressed by the lever 38 on the standard 30 between the foot 43 of the player's leg 41 (see FIG. 6) and the projection 44 on the upper end of 41 or buttocks of the player figure 40. Also operated by the spring 42 inside the animated player figure 40 there is a piston 45 which operates on a cam surface 36 on the shoulder pivot of arm 47 to raise the arm 47 which releasably holds in its hand 52 the ball 60. The other arm 48 may be similarly pivoted and raised at the same time as arm 47 if desired, or it may be preset. Similarly for the other leg 49 which is articulatedly journalled in the torso body portion of the player figure 40.

Thus once the player figure and its stand 30 are located on the court floor 10 so as to be directed toward the ring 26, manual operation of the lever 38 as shown by the fingers F in FIG. 1, the upper part of the lever 38 is removed from the projection 44 on the upper end of the leg 41, the spring 42 immediately self-projects the player figure 40 toward the goal or ring 26 and simultaneously raises the arm 47 with the bail 60 therein into the position shown in FIGS. 1 and 6. Since the player actually jumps toward the ring 26, there may be provided as shown in FIGS. 3 and 6 adhering roughened surfaces 55 and 28, such as VELCRO, on the player's wrist and the ring 26, respectively, so that the player, when he contacts the ring 26, will land thereon.

In FIG. 7 there is shown in the center of the palm of the hand on arm 47 a projection 52 which fits into a slot 62 in the ball 60 so that when the ball 60 hits the ring 26 it will be knocked off of the projection 52 to fall through the ring 26 or into the basket.

While there is described above the principles of this invention in connection with a specific apparatus, it is to be clearly understood that this description is made only by way of example, and not as a limitation to the scope of this invention.

I claim:

1. A toy ball game with an animated figure player having a leg and a hand on an arm, a court for said player, and a goal for a ball, the improvement comprising:

A) a compressible launching spring in the leg of said player,

B) a recess in the hand of said player for releasably holding a ball, and

C) removable base for said player with a latching means for compressing and releasing said spring to launch said player and said ball in the player's hand toward said goal.

2. A game according to claim 1 including a plurality of said players.

3. A game according to claim 1 including a movable base for each of said players.

4. A game according to claim 1 wherein said base has a rotatable wedge-shaped base plate for changing the angle of launch of said player from said base.

5. A game according to claim 1 wherein said goal and the arm of said player have adhering surfaces whereby said player can hang on said goal.

6. A toy basketball game comprising a court floor, a post backboard with ring and net mounted on said floor, an articulated player, and a movable base for supporting said player, the improvement comprising: a compressible spring inside the leg of the player for launching said player, and a manually releasable clamp on said movable player base for compressing and releasing said spring to have said player jump toward said ring.

7. A game according to claim 6 wherein said spring when released also raises the arm of said player for releasably holding.

8. A game according to claim 7 wherein said raised arm is pivoted at the shoulder, which pivot inside said player contains a cam surface which is acted upon by a piston urged toward said cam by said launching spring.

9. A toy basketball game comprising a court, a basket on a stand in said court, said basket having a ring to receive a ball, and at least one animated player having movable limbs and a releasable ball in the hand of an outstretched arm of said player, the improvement comprising:

a) a support for said player having a manually-operated lever for releasing said player clamped in said support by said lever, and b) a spring in a leg of said player compressed by the clamping action of said lever, whereby the object of said game is to so locate said support in said court so that said player can be self-catapulted from said support toward said basket and so that the ball in the player's hand can contact said ring of said basket to release said ball into said basket.

10. A game according to claim 9 wherein said outstretched hand and said ring have rough surfaces whereby when contacted the player hangs from said ring.

11. A game according to claim 9 wherein unclamping said player in said support by said lever outstretches said arm of the player holding said ball.

12. A game according to claim 9 wherein said player has a telescopic leg in which said spring is compressed by said lever between the foot of said leg and a projection on the upper end of said leg.

13. A game according to claim 9 wherein said hand contains a projecting tab which releasably fits into a slot in said ball.

14. A game according to claim 9 wherein said support comprises a wedge-shaped rotatable base for changing the angle of launching of said player.

15. A toy basketball game comprising:

A) a court,

B) a goal attached to said court and including a basket having a ring,

C) at least one articulated player having a launching spring in one telescoping leg and an outstretched arm releasably holding a ball in its hand, D) a supporting base for said player having a rotatable wedge-shaped base and a clamping lever for compressing said spring in said telescopic leg, and E) a ball with a slot therein that releasably fits into a projection in said outstretched arm of said player, whereby the operation of said clamping lever causes the spring in said telescopic leg to catapult said player with its outstretched hand carrying said ball toward said ring of said basket.

* * * * *

UNITED STATES PATENT AND TRADEMARK OFFICE

CERTIFICATE OF CORRECTION

PATENT NO. : 5,690,330

DATED : November 25, 1997

INVENTOR(S) : Isamu Ozawa

It is certified that error appears in the above-indentified patent and that said Letters Patent is hereby corrected as shown below:

Column 2, line 50, after "of" ( first occurrence) insert - - leg - - .

Claim 7, line 3, before "." insert - - a ball - - .

Signed and Sealed this

Fifth Day of May, 1998

Bruce Lehman

*Attest:*

BRUCE LEHMAN

*Attesting Officer*

*Commissioner of Patents and Trademarks*